United States Patent [19]

Wagner

[11] Patent Number: 4,831,855

[45] Date of Patent: May 23, 1989

[54] FLARING TOOL AND APPARATUS EQUIPPED WITH A FLARING TOOL

[75] Inventor: Rudolf Wagner, Stuttgart, Fed. Rep. of Germany

[73] Assignee: Rems-Werk Christian Föll und Söhne GmbH & Co., Waiblingen, Fed. Rep. of Germany

[21] Appl. No.: 116,652

[22] Filed: Nov. 3, 1987

[30] Foreign Application Priority Data

Nov. 3, 1986 [DE] Fed. Rep. of Germany ..... 3637292
Dec. 20, 1986 [DE] Fed. Rep. of Germany ..... 3643727

[51] Int. Cl.[4] ..... B21D 39/08

[52] U.S. Cl. ..... 72/118; 72/117; 72/125; 72/318

[58] Field of Search ..... 72/75, 112, 115, 116, 72/117, 118, 120, 123, 125, 316, 317, 318

[56] References Cited

U.S. PATENT DOCUMENTS 2,861,623 11/1958 Franck ..... 72/117
3,683,657 8/1972 Davies ..... 72/112
3,818,734 6/1974 Bateman ..... 72/118

FOREIGN PATENT DOCUMENTS 926748 5/1973 Canada ..... 72/75

*Primary Examiner*—Lowell A. Larson
*Attorney, Agent, or Firm*—Becker & Becker, Inc.

[57] ABSTRACT

A flaring tool and flaring apparatus for cylindrically flaring the ends of tubes. The flaring tool is provided in the vicinity of one end thereof with flaring elements that are fixedly connected thereto and have an at least approximately spherical shape. The flaring elements are essentially in point-type contact with the tube and generate high specific deformation forces during flaring. When the flaring tool is rotated about its axis, the tube end is continuously flared. The flaring apparatus has an adapter that can be shifted via a thread connection. The adapter fixedly accommodates the flaring tool, and can be connected to a drive unit.

20 Claims, 3 Drawing Sheets

FLARING TOOL AND APPARATUS EQUIPPED WITH A FLARING TOOL

BACKGROUND OF THE INVENTION

The present invention relates to an expanding or flaring tool, in the region of one end of which are provided flaring elements for cylindrically flaring one end of a tube. The present invention also relates to an apparatus that is equipped with such a tool.

Especially in the plumbing industry, the ends of tubes or conduits are cylindrically flared with such flaring tools, whereupon another tube is inserted into the flared end of the conduit and is then soldered thereto. The heretofore known flaring tools have a plurality of flaring elements or sections that can be shifted radially outwardly via a mandrel that is axially displaceably disposed in the flaring tool. The flaring tool is first introduced into the end of the tube with the mandrel retracted. The mandrel is subsequently displaced axially forwardly, whereby the flaring elements are pressed outwardly to thereby cylindrically flare the tube end. However, considerable forces are necessary to accomplish this because the entire periphery of the tube is flared at the same time. Thus, powerful drive units are necessary for these heretofore known flaring tools. In addition, it is possible to handle only relatively soft tubes with these heretofore known flaring tools because otherwise extremely great forces must be applied to deform the tube ends. The tubes in the plumbing industry frequently are made of copper. In order to be able to flare such copper tubing, the tubes must first be soft-annealed in a complicated procedure.

It is an object of the present invention to provide a flaring tool and a flaring apparatus that make it possible to flare tubes, with relatively little force, without having to first prepare the tubes.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
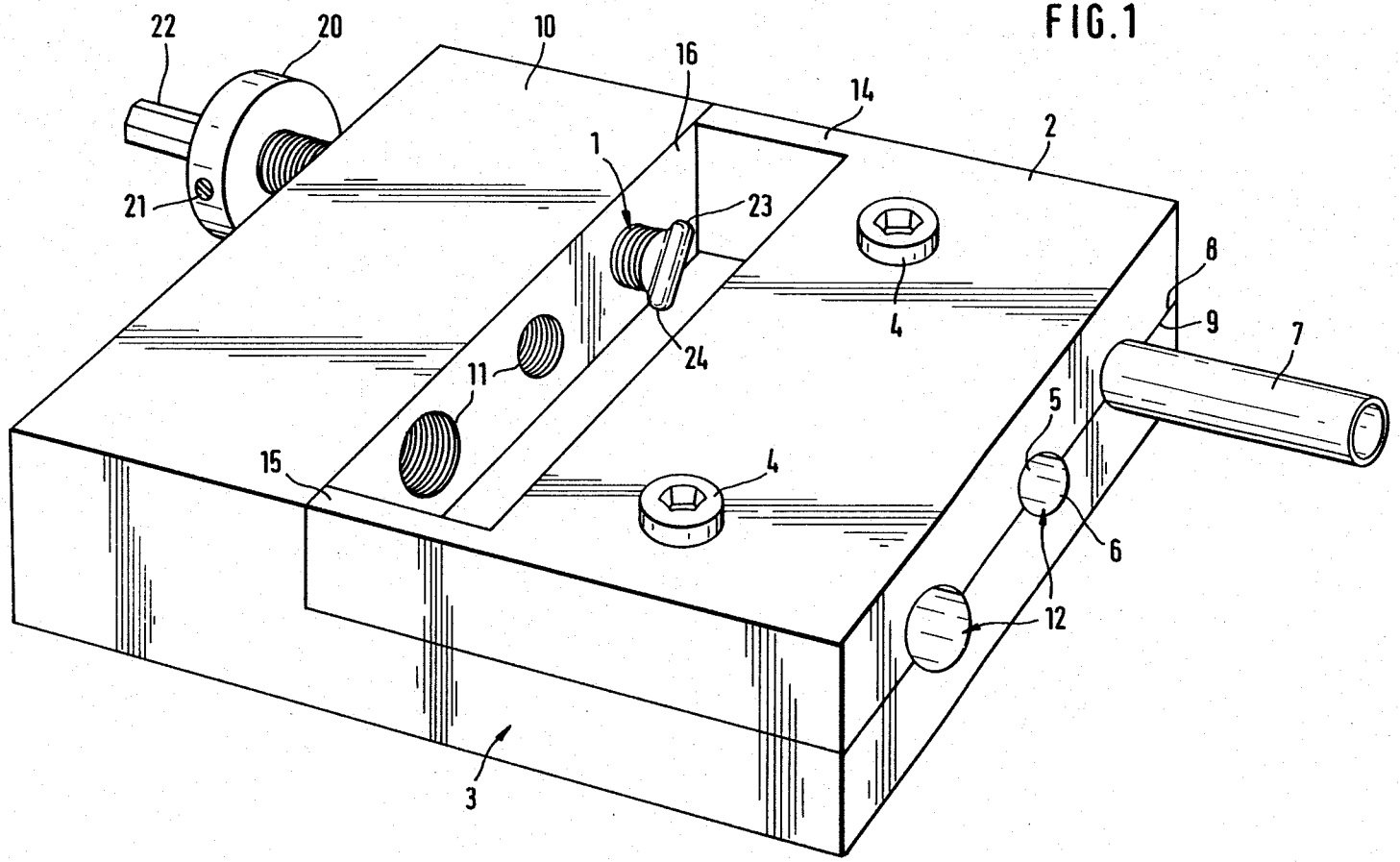
FIG. 1 is a view that schematically illustrates one exemplary embodiment of the inventive flaring apparatus equipped with an inventive flaring tool.

The flaring tool of the present invention comprises a shaft, and flaring elements that are fixedly connected to the shaft in the vicinity of one end thereof, with the flaring elements having an at least approximately spherical shape and serving for the cylindrical flaring of one end of a tube.

The flaring apparatus of the present invention is equipped with the inventive flaring tool and comprises a holder and an adapter that is displaceably held in the holder via thread means, with the flaring tool being adapted to be fixedly held by the adapter for movement therewith, the adapter being adapted to be positively connected to a drive unit or rotation thereby.

The at least approximately spherical shape of the flaring elements of the inventive flaring tool permits high specific deformation forces to be generated in the tube because the flaring elements are practically in only point-type contact with the tube. When the flaring tool is rotated, the entire circumference of the tube end is not simultaneously flared. Rather, flaring occurs only in the contact zone between the flaring elements and the tube. It is not necessary to have powerful rotary drives in order to drive the inventive flaring tool. The friction during the flaring process is similarly low due to the only point-type contact. Due to the high deformation forces that can be exerted with the inventive spherical flaring elements, it is no longer necessary to soft-anneal the, for example, copper tubes prior to the flaring process. As a result, handling of the tubes is considerably simplified. With the inventive flaring apparatus, the tubes can be flared in a straightforward manner with little expenditure of energy. The adapter is rotated via the rotary drive unit. The flaring tool, which is fixedly connected to the adapter, is taken along by the latter. Via the thread connection, the adapter, along with the flaring tool, are axially displaced during movement, so that the friction tool is thrust into the tube end that is to be flared.

Further specific features of the present invention will be described in detail subsequently.

DESCRIPTION OF THE PREFERRED EMBODIMENT

Referring now to the drawings in detail, shown is an expanding or flaring tool with which the ends of tubes or conduits can be cylindrically flared. The flaring apparatus is a portable device that can be easily carried by the user.

Figure 2:
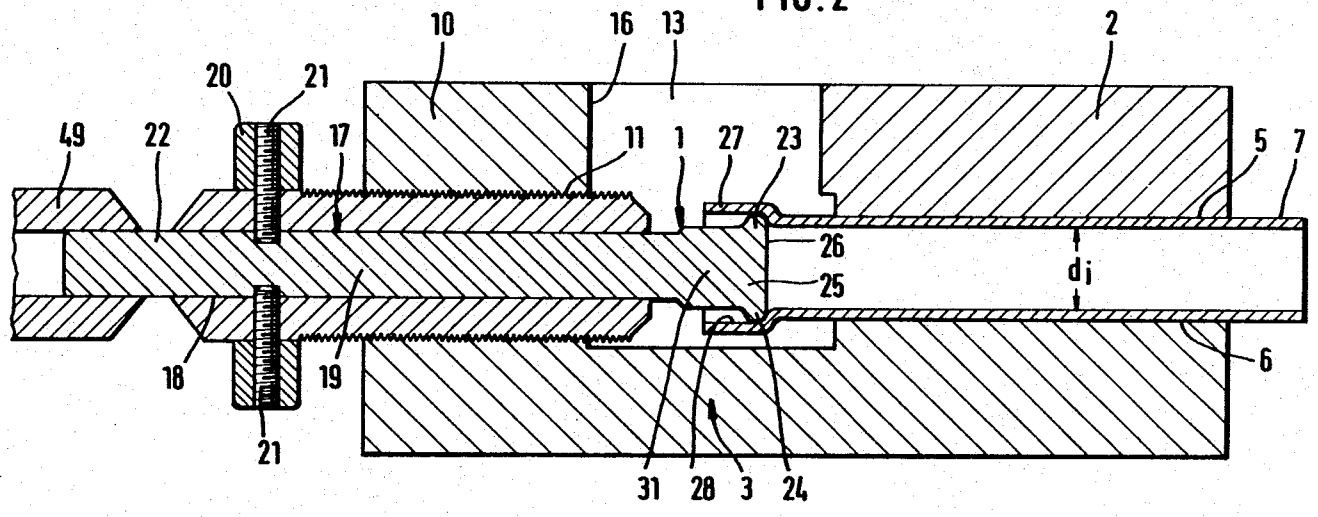
FIG. 2 is a longitudinal cross-sectional view through the flaring apparatus of FIG. 1, with the flaring tool being in engagement with a workpiece.

The flaring apparatus shown in FIGS. 1 and 2 essentially comprises two gripping jaws 2 and 3 that can be interconnected by clamping screws 4. When viewed in cross-section, each of the gripping jaws 2, 3 has approximately semicircular recesses 5 or 6 respectively into which can be placed a tube or conduit 7 that is to be flared. So that tubes 7 of various diameters can be handled with the same flaring apparatus, the latter is provided with recesses 5, 6 of various sizes into which can be placed a tube having a corresponding diameter. So that a tube 7 can be reliably and securely clamped between the two gripping jaws 2, 3, the recesses 5, 6 are dimensioned in such a way that when a tube 7 is clamped in, those sides 8, 9 of the gripping jaws 2, 3 that face one another do not rest against one another; rather, they are slightly spaced from one another, though this is not shown in FIG. 1. In this way, the tubes 7 can be satisfactorily and tightly clamped into the recesses 5, 6.

In place of the clamping screws 4, the flaring apparatus can also be provided with snap-tight closures so that the gripping jaws 2, 3 can be rapidly detached from, and interconnected with, one another.

The gripping jaw 2 has a block-like attachment 10 that is preferably integral with the latter and is provided with threaded holes 11. The holes 11 are aligned with the receiving means 12 formed by the recesses 5, 6 for the tubes 7. At that end which faces the attachment 10, the gripping jaw 2 is provided with a rectangular recess or cutout 13 that is delimited at the sides by side walls 14 and 15 of the gripping jaw 2. The end faces of the side walls 14, 15 of the gripping jaw 2 can rest against the end face 16 of the attachment 10 of the gripping jaw 3.

As shown in FIG. 2, a guide element or adapter 17 is screwed into the appropriate threaded hole 11 of the attachment 10. The longitudinal bore 18 of the adapter 17 accommodates the expanding or flaring tool 1, which has a shaft 19 that extends through the longitudinal bore 18. Both ends of the shaft 19 project beyond the adapter 17, and the shaft 19 is securely connected to the adapter. An attachment or stop member 20 is seated on the adapter 17 for determining the maximum length of the end of the tube that is to be flared by abutment against the gripping jaws 2, 3. By means of set screws 21, the stop member 20 is securely connected to the adapter 17. The set screws 21 also rigidly connect the flaring tool 1 to the adapter 17. It is, of course, also possible to make the stop member 20, the adapter 17, and the flaring tool 1 as a single piece. However, the multi-part construction has the advantage that the flaring tool 1 can be replaced if necessary, for example after a given amount of wear. The adapter 17 is generally not subjected to as much wear as is the flaring tool 1, so that the adapter can be used for several flaring tools. At least that end 22 of the flaring tool 1 that projects beyond the adapter 17 has a multi-sided configuration and can be coupled to a drive motor. Suitable for this purpose is, for example, a hand drill, into the chuck 49 of which the end 22 of the flaring tool 1 can be inserted and clamped. The flaring tool 1 can then be rotated about its axis with the drill.

Since the flaring tool 1 is securely connected to the adapter 17, when the flaring tool 1 is driven the adapter 17 is also rotated. Since the adapter is disposed in the threaded hole 11 of the attachment 10, the adapter is screwed into or out of the threaded hole 11, depending upon the direction of rotation. The flaring tool 1 is taken along, and if movement is toward the gripping jaw 2, the flaring tool is moved against the clamped-in tube 7. The threads of the threaded holes 11 and of the adapter 17 have only a slight pitch, so that the flaring tool 1, which is also axially securely connected to the adapter 17, can be shifted exactly in the axial direction.

Figure 3:
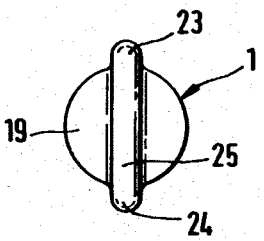
FIG. 3 is an end view of one exemplary embodiment of the inventive flaring tool.

That end of the flaring tool 1 which faces the tube that is to be handled is provided with two flaring elements 23 and 24 that are disposed diagonally across from one another (see FIGS. 1 to 3). These flaring elements 23, 24 project radially beyond the shaft 19 and are interconnected by a diametrically extending crosspiece 25. The flaring elements 23, 24 are preferably the ends of this crosspiece 25. The appropriate end of the tube 7 is flared with the flaring elements 23 and 24. So that in so doing great friction cannot occur, yet high specific deformation forces can be achieved in the tube, the flaring elements 23, 24 have a spherical shape. The surface of the flaring elements 23, 24 is curved not only in the axial direction but also in the circumferential direction. The radius of curvature is less than the radius of the shaft 19. As shown in FIG. 2, the end face 26 of the crosspiece 25 is planar and extends at right angles to the axis of the shaft 19.

To flare the end 27 of the tube 7, the gripping jaw 2, after loosening the clamping screws 4 or a snap closure, is first removed from the gripping jaw 3 and the tube 7 is placed into that recess 6 of the gripping jaw 3 which corresponds to the diameter of the tube. The gripping jaw 2 is subsequently placed over the tube 7, which is tightly clamped in the respective receiving means 12 by tightening the clamping screws 4. The tube end 27 that is to be flared then projects into the cutout 13 (FIG. 2). The adapter 17 can be screwed into the threaded hole 11 via a drive motor. In any case, the flaring tool 1 for flaring the tube end 27 can be rotatably driven by an appropriate drive motor. Via the threaded connection, the flaring tool 1 is shifted axially against the tube 7.

The spherical flaring elements 23, 24 generate very high specific deformation forces in the tube 7 since these flaring elements are essentially in only point-contact with the inner surface 28 of the tube end 27. The deformation of the tube 7 occurs only in the region of the flaring elements 23 and 24, in other words, in only a very small zone. As a result, the deformation exertion is slight. Therefore, a relatively low-power drive is sufficient to rotate the flaring tool 1. The flaring elements 23, 24 are not adapted to the shape of the tube end 27 that is to be deformed. As a result, in conjunction with the essentially only point-type contact, the friction between the flaring tool 1 and the tube 7 is kept very low, which also has an advantageous effect on the drive energy. The flaring tool 1 can therefore be driven, for example, with a conventional hand drill. The inventive flaring apparatus is therefore especially suitable for use at construction sites or in hobby workshops. In particular, hand drills that are present any way, for example, at construction sites can be used to drive the flaring tool 1. It is not necessary to have separate drive devices. Thus, the inventive flaring apparatus represents an auxiliary tool for hand drills. The flaring tool 1 is rotated, and hence is axially moved against the tube 7, until the flared tube end 27 has reached the desired length. The flaring tool 1 is subsequently retracted until it has exited the tube end 27.

Tubes having cylindrically flared ends are used especially in the plumbing industry and are frequently made of copper. Since the tube end 27 is deformed in only a point-type manner by the flaring tool 1, and in so doing very high specific deformation forces can be exerted, it is not necessary to soft-anneal such a copper tube prior to flaring, as was necessary with the heretofore known flaring apparatus having expandable flaring tools. THus, the annealing process is eliminated with the inventive flaring apparatus, which, however, can also be used to flare tubes made of soft steel, brass, or other materials.

Since the flaring elements 23, 24 project radially beyond the shaft 19 of the flaring tool 1, the already widened area of the tube end 27 does not come into contact with the shaft 19 as the flaring tool 1 is fed in or advanced, so that the friction can be kept very low. As a result of the rotational movement and the axial advancement effected thereby, very small regions of the tube end 27 only are regularly plastically deformed, so that no great drive forces are needed in order to flare the tube end 27 during advancement and rotation of the flaring tool 1.

Figure 4:
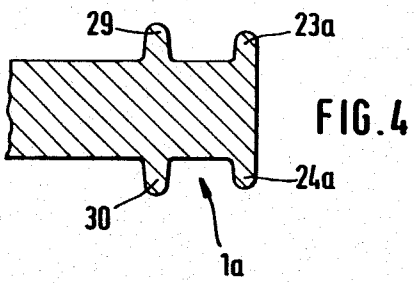
FIG. 4 is a cross-sectional view of a portion of a second exemplary embodiment of the inventive flaring tool.

FIG. 4 shows a further exemplary embodiment of a flaring tool 1*a* that, in addition to the flaring elements 23*a*, 24*a* at the free end, is provided with further flaring elements 29 and 30 that project further radially outwardly than do the flaring elements 23*a*, 24*a*. The flaring elements 29, 30 are also spherical, thus having an upper surface that is curved both in the circumferential and axial directions. The flaring elements 29, 30 are spaced from the flaring elements 23*a*, 24*a*. When viewed in the axial direction, the flaring elements 29, 30 can be even with the flaring elements 23*a*, 24*a*, or can be offset in the circumferential direction relative to the latter.

The flaring tool 1*a* with the four deformation elements 23*a*, 24*a*, 29, 30 is used to flare thick-walled tubes and/or when the tube ends have to be flared quite a bit. Since great plastic deformations are required in this connection, the flaring elements 29, 30, which follow in the direction of advancement of the flaring tool 1a, again deform the tube end 27, which was already flared by the flaring elements 23*a*, 24*a*, so that there is no danger that the flared tube end will draw together slightly as soon as the flaring elements 23*a*, 24*a* are pulled out of the tube 7. In other words, if greater plastic deformations are to be undertaken, there is the danger that if only the flaring elements 23*a*, 24*a* are used, the flared tube end 27 will draw together slightly elastically after the flaring tool is withdrawn, so that the tube end does not have the desired inner diameter. Therefore, the tube end 27 is again slightly plastically deformed with the flaring elements 29, 30 subsequent to flaring with the flaring elements 23*a*, 24*a* in order to enlarge the diameter. This additional deformation assures that the tube end retains the desired enlarged inner diameter after the flaring tool 1*a* is withdrawn.

Since very high forces occur in the region of the flaring elements, this end region 31 of the flaring tool 1, 1*a* is preferably wider than the rest of the tool (FIG. 2).

In a very straightforward embodiment of the inventive flaring apparatus, it is possible for the gripping jaws 2, 3 to have only a single receiving means 12.

Figure 5:
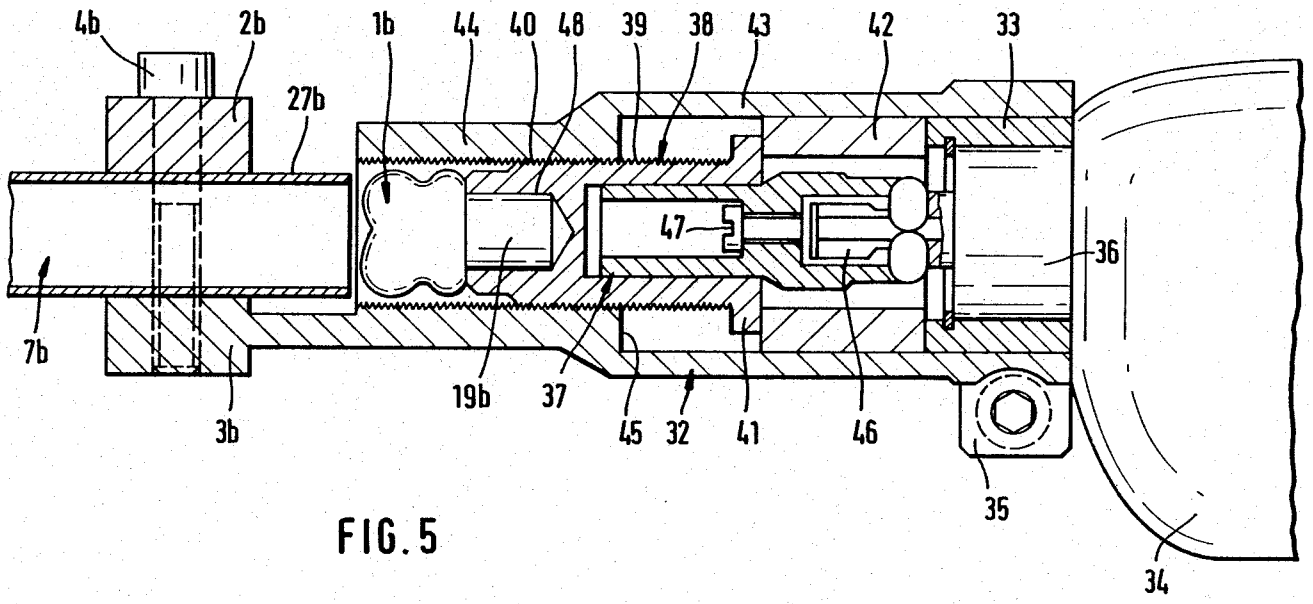
FIG. 5 is an axial cross-sectional view of a third exemplary embodiment of the inventive flaring tool for the inventive flaring apparatus, which is secured to a drive unit.

In the embodiment illustrated in FIG. 5, the flaring tool 1*b* is also a component of a flaring apparatus, which is embodied as a portable device that can easily be carried by the user.

The flaring apparatus has two gripping jaws 2*b* and 3*b* that can be interconnected by clamping screws 4*b*. The tube 7*b* that is to be flared is clamped-in between the two gripping jaws 2*b* and 3*b*. As described in connection with the embodiment illustrated in FIGS. 1 and 2, recesses that each have an approximately semicircular cross-sectional shape are provided in the gripping jaws 2*b*, 3*b* for receiving the tube 7*b* that is to be flared. Again, it is possible to provide recesses of different sizes in the gripping jaws 2*b*, 3*b* so that the same flaring apparatus can be used for handling tubes 7*b* of various diameters. In place of the clamping screws 4*b*, the flaring apparatus can also be provided with snap closures so that the gripping jaws 2*b*, 3*b* can be rapidly disconnected from, and interconnected with, one another.

One of the gripping jaws, in the illustrated embodiment the gripping jaw 3b, is provided with an extension 32 that is preferably embodied in one piece with the working jaw, and that is placed on a collar element 33 of a drive unit 34. In order to ensure a secure seating of the extension 32 on the collar 33, the extension 32 is tightly clamped to the collar. A clamping ring can be used for this purpose. In the illustrated embodiment, this clamping ring 35 is part of the extension 32.

A drive spindle or arbor 36 of the drive unit 34 is rotatably mounted in the collar element 33 of the drive unit, which can, for example, be a conventional drill. A driver 37 having a multisided shape is screwed onto the drive arbor 36. A sleeve-like adapter or drive member 38 is axially displaceably mounted on the driver 37. An external thread 39 on the adapter or drive member 38 meshes with an internal thread 40 of the extension 32. That end of the member 38 that faces the drive arbor 36 is provided with a radially outwardly directed flange 41 that serves as a stop to limit the axially inward displacement path of the adapter or drive member 38. The flange 41 can cooperate with a counter-abutment 42 that in the illustrated embodiment is in the form of a ring and rests against not only the inner wall of the extension 32 but also against the end face of the collar 33. The counter-abutment 42 can, for example, also be a spring or snap ring that is placed in a groove in the inner wall of the extension 32. Similarly, this counter-abutment 42 could be formed by a radially inwardly extending projection of the extension 32. Finally, it is also possible to have no counter-abutment on the extension 32 for the flange 41. However, the counter-abutment 42 has the advantage that with it the retracted position of the adapter or drive member 38 can be precisely determined.

The counter-abutment 42 is accommodated in a portion 43 of the extension 32 that has a larger inner diameter. An abutment surface 45 that is disposed transverse to the axis of the adapter or drive member 38 is formed at the transition of the wider portion 43 to a portion 44 of the extension 32 that has a smaller inner diameter; this abutment surface 45 is disposed in the path of movement of the flange 41 of the adapter or drive member 38. The abutment surface 45 thus determines the outermost position of the flaring tool 1*b*. The internal thread 40 is provided in the portion 44 of the extension 32.

The driver 37 is embodied as a sleeve and is placed on the driver portion 46 of the drive arbor 36, being detachably connected thereto via a screw 47. The screw 47 is in a protected position within the driver 37.

That end of the drive member 38 that projects beyond the driver 37 is provided with a blind hole 48 into which the shaft 19*b* of the flaring tool 1b is inserted. The flaring tool 1*b* is detachably connected to the drive member 38 in a suitable manner, so that different flaring tools can be used or damaged flaring tools can easily be replaced. It is, of course, also possible to embody the flaring tool 1b and the drive member 38 as a single piece.

In FIG. 5, the flaring tool 1*b* is illustrated as being in its furthermost retracted position, in which it is disposed completely within the narrower portion 44 of the extension 32. The flange 41 rests against the counter-abutment 42. The tube 7*b* that is to be flared is clamped between the gripping jaws 2*b* and 3*b*, with the tube end 27*b* that is to be flared extending beyond the gripping jaws 2*b*, 3*b*, facing the flaring tool 1*b*, and extending nearly to the free end of the narrower portion 44 of the extension 32. To flare the tube end 27*b*, the drive unit 34 is turned on, so that the drive arbor 36 rotates about is axis. In so doing, the drive arbor 36 drives the driver 37 along with it. Since the driver 37 has an angular outer shape, the drive member 38 is also taken along in the direction of rotation. As a result of the meshing of the threads 39 and 40, the drive member 38 is axially shifted on the driver 37 and the flaring tool 1*b* is shoved into the tube end 27*b*, which as a result is cylindrically flared by the flaring tool 1*b*. Since the flaring apparatus is mounted on the collar element 33 of the drive unit 34, the reaction torque that occurs during flaring of the tube 7*b* is absorbed by the drive unit 34 itself, so that it is no longer necessary for the user of the apparatus to absorb the counter-torque. As a r4e4sult, the tube end can be easily flared with the inventive apparatus without having to exert a great deal of force. During a flaring operation, the user doesn't even have to hold the drive unit 34 but rather can support the unit on some other surface. This makes it possible to work without tiring.

Since all of the drive parts of the flaring apparatus, namely the drive arbor 36 with the drive portion 46, the sleeve-like driver 37, and the drive member 38, are accommodated in the extension 32, these parts are reliably protected from damage and/or dirt. Except for its very short shaft 19*b*, the flaring tool 1*b* is embodied in the same way as the embodiment illustrated in FIG. 4. However, the flaring tool 1*b* could also have an embodiment similar to that of the flaring tool 1 illustrated in FIGS. 1 to 3.

The present invention is, of course, in no way restricted to the specific disclosure of the specification and drawings, but also encompasses any modifications within the scope of the appended claims.

What I claim is:

1. A flaring tool that is rotatable about its axis and that is adapted for widening and expanding a tube cylindrically as to an end thereof and comprises:

a shaft having a first end as well as a second end and having a guide part rigidly connected therewith, said guide part being rotatable via a rotary drive for axial shifting, said guide part engaging a clamping device having a block-like attachment receiving portion for securing therein the tube to be subjected to said widening and said expanding; and flaring elements that are fixedly connected to said shaft in the vicinity of said first end thereof and arranged sequentially in axial direction of the flaring tool, with said flaring elements having an at least approximately spherical shape and serving for the cylindrical flaring of one end of a tube, said flaring elements sequentially having greater working diameter than preceding flaring elements.

2. A flaring tool according to claim 1, in which said flaring elements are integral with said shaft of said flaring tool.

3. A flaring tool according to claim 2, in which said flaring elements are disposed diametrically across from one another on said shaft.

4. A flaring tool according to claim 3, in which at least some of said flaring elements are formed by the ends of a crosspiece provided on said first end of said shaft.

5. A flaring tool according to claim 2, in which said flaring elements project radially beyond said shaft, which is adapted to be disposed in an adapter that can be screwed into a threaded hole.

6. A flaring tool according to claim 5, in which said shaft projects axially beyond said adapter.

7. A flaring tool according to claim 5, in which said shaft is fixedly connected to said adapter.

8. A flaring tool according to claim 5, in which said adapter is provided with stop means.

9. A flaring tool according to claim 1, in which said flaring elements include two sets of flaring elements, namely a first set near said first end of said shaft, and a second set that is disposed further from said first end of said shaft and has a greater working diameter than does said first set of flaring elements.

10. A flaring tool according to claim 9, in which said flaring elements of said second set of flaring elements, which is axially spaced from said first set of flaring elements, are disposed diametrically across from one another.

11. A flaring tool according to claim 9, in which said flaring elements of said second set of flaring elements, when viewed in the axial direction of said shaft, are even with said flaring elements of said first set of flaring elements.

12. A flaring tool according to claim 1, in which the region of said first end of said shaft, which carries said flaring elements, is thicker than the remainder of said shaft.

13. A flaring apparatus equipped with the flaring tool of claim 1, said apparatus comprising:

a holder; and an adapter that is displaceably held in said holder via thread means, with said flaring tool being adapted to be fixedly held by said adapter for movement therewith, said adapter in turn being adapted to be positively connected to a drive unit for rotation thereby.

14. A flaring apparatus according to claim 13, in which said adapter is connected directly to said drive unit via said second end of said shaft.

15. A flaring apparatus according to claim 13, in which said drive unit is provided with a drive arbor; which includes a drive that is operatively connected to said drive arbor; in which said adapter is seated on said driver in such a way that it rotates with the latter yet can be axially displaced relative thereto; and in which said apparatus is securely connected to said drive unit.

16. A flaring apparatus according to claim 15, which includes stop means for limiting the displacement path of said adapter in at least one direction.

17. A flaring apparatus according to claim 16, in which said adapter is provided with a flange-like member as a counter-stop.

18. A flaring apparatus according to claim 16, which includes an extension member having an inner surface on which is provided said stop means.

19. A flaring apparatus according to claim 18, in which said drive unit is provided with a collar, and in which said stop means is a ring that fixedly rests against said collar.

20. A flaring apparatus according to claim 15, in which said drive arbor is provided with a driver portion; and in which said driver has a sleeve-like configuration and is disposed on said driver portion of said drive arbor.

* * * * *